United States Patent [19]

Daniels

[11] 4,198,715

[45] Apr. 22, 1980

[54] SHOWER CABINET AND BASE

[75] Inventor: Phillip D. Daniels, Novi, Mich.

[73] Assignee: Novi Plastics Company, Novi, Mich.

[21] Appl. No.: 955,975

[22] Filed: Oct. 30, 1978

[51] Int. Cl.[2] ..... A47K 3/22

[52] U.S. Cl. ..... 4/146; 52/98; 52/198

[58] Field of Search ..... 4/145–148, 4/1, 152, 153, 160–164, 166, 170, 187 R, 187 A, 173 R, 173 M, 174, 175; 52/98, 100, 198, 792, 806, 830; 312/228

[56] References Cited

U.S. PATENT DOCUMENTS

| | | | |
|---|---|---|---|
| 2,343,201 | 2/1944 | Nilson | 4/146 X |
| 2,400,683 | 5/1946 | Burnett | 4/146 |
| 2,567,506 | 9/1951 | Bowman | 4/147 |
| 2,757,385 | 8/1956 | Wlittick | 4/146 |
| 3,385,012 | 5/1968 | Lovegreen | 52/100 X |
| 3,462,771 | 8/1969 | Moretti | 4/146 |
| 3,551,918 | 1/1971 | Bergmark | 52/198 X |
| 3,606,617 | 9/1971 | Frazier | 4/145 |
| 3,629,875 | 12/1971 | Dow | 4/146 |
| 3,895,398 | 7/1975 | Mustee | 4/145 X |
| 3,925,828 | 12/1975 | Kim | 4/147 |

*Primary Examiner*—Stuart S. Levy

*Attorney, Agent, or Firm*—Cullen, Sloman, Cantor, Grauer, Scott & Rutherford

[57] ABSTRACT

A shower cabinet comprises a base, side and back panels upon the base and a door. The base construction which may be used in combination with the cabinet and door may be adapted for use in conjunction with other available shower cabinets and enclosures. The base includes an upper floor and a lower base plate, the base plate having a pair of selectively usable knockout drain discs formed therein providing normally closed openings adapted to selectively receive a drain assembly. The base plate has an upstanding side will therearound and an outer upstanding peripheral side flange defining therebetween an intermediate support shoulder adapted to receive and support the upstandng shower cabinet walls. A first selectively usable knockout drain disc is formed within the base plate side wall to provide a normally closed opening adapted to selectively receive a side drain assembly, and a selectively usable knockout drain disc is formed in the bottom wall of the base plate to provide, when removed, a bottom drain opening. A spacer is interposed between the base plate and the floor, the floor having a central drain. A series of spaced drain slots are formed through the floor at the edge thereof for communication to the base plate thereunder. Water from the shower thus drains through the floor drain into the space between the base plate and the floor, to be removed through either the center drain opening or the side drain opening.

12 Claims, 8 Drawing Figures

FIG. 5
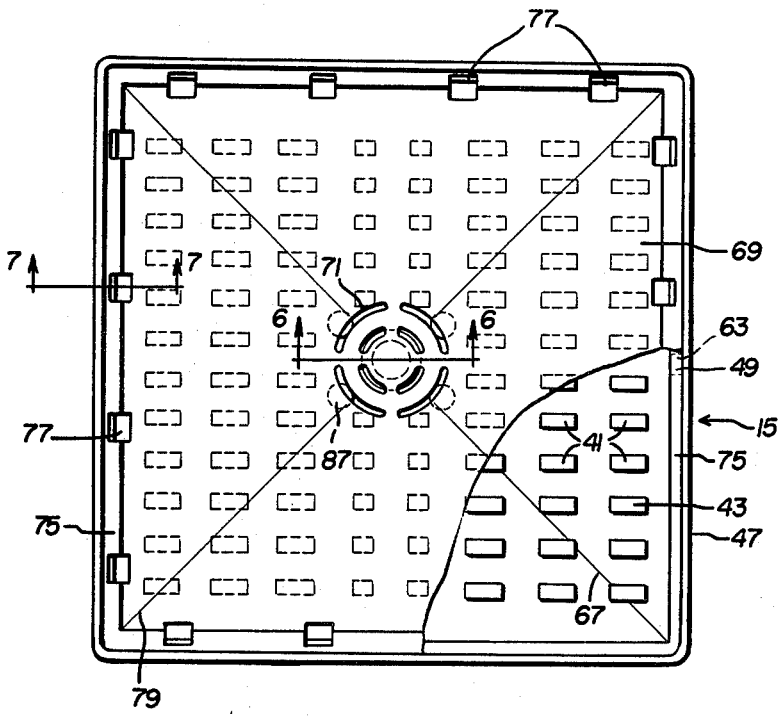
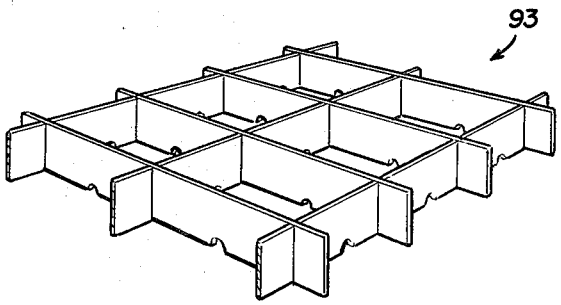
FIG. 8
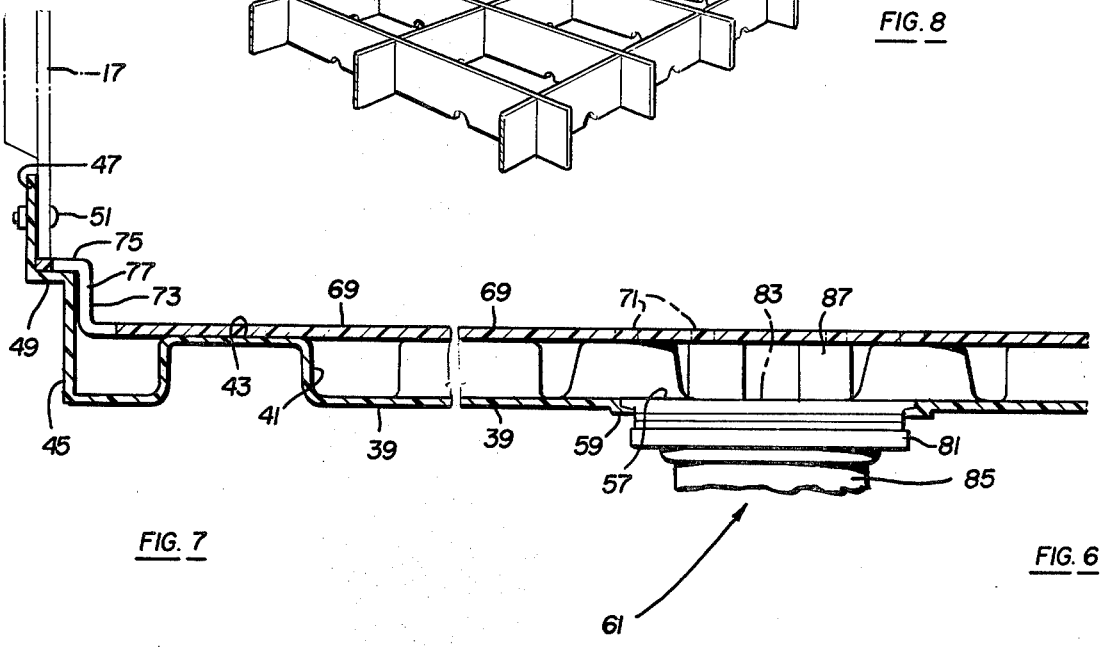
FIG. 7
FIG. 6

SHOWER CABINET AND BASE

BACKGROUND OF THE INVENTION

Pre-formed and packaged plastic shower cabinet units are currently used extensively and they have, in many instances, replaced the older type tub and ceramic tile shower enclosures. The ready-to-assemble shower cabinet units typically have a shower enclosure assembly, a shower base, and a shower door; and the unit can be quickly installed into a roughed-in-location or replace an existing unit.

A problem has existed when side drainage from the shower cabinet unit is required. Shower cabinet units normally are provided with a shower base having a center drain. This is acceptable if the shower cabinet can be installed directly over a floor drain. For side drainage, the waste water is collected from the conventional central drain and transported through a side wall to a drain outside the confines of the shower unit. In situations where the shower unit was installed other than directly over a floor drain, the shower base had to be elevated on an additional frame or a special elevated shower base had to be purchased.

The customer, retailer and manufacturer are inconvenienced by the prior art methods and apparatus for side drainage from shower bases. The customer must make or purchase an elevated shower base which is aesthetically unappealing, which is considerably more expensive, and which requires additional support and reinforcement. The retailer must stock both the regular center drain shower base and the elevated side drain shower base. The manufacturer's costs are increased because the elevated shower base requires a different size container, and fewer side drain shower bases can be shipped or stored.

Another problem with prior shower cabinet units has been with the shower enclosure. Typically, a shower enclosure has two side panels, a back panel, and a shower door. The side and back panels are secured uprightly in the shower base and to each other thereby forming a partial enclosure. The shower door is pivotally mounted to one of the side panels to complete the enclosure.

Prior art shower enclosures that are mounted into the shower base are costly because of the ratio of weight to interior size. The side and back panels are normally thick plastic so that they can stand upright with little or no reinforcement. The panels have not heretofore provided maximum interior space and light weight. Exemplary of such prior art are U.S. Pat. Nos. 3,606,617; 3,895,398; and 3,551,918.

Thus, the present invention relates to a shower cabient unit having an improved shower base and an improved shower enclosure.

SUMMARY OF THE INVENTION

The invention herein relates to a simplified shower cabinet assembly which may be conveniently packaged and quickly installed. The assembly has two component parts: an improved shower enclosure and an improved shower base unit.

The improved shower enclosure has two plastic side panels and a plastic back panel. The two side panels and flat back panel are assembled upright in an improved shower base to form an enclosed structure with an opening for a mounted shower door.

Each side panel is injection molded or vacuum formed and each panel has a front corner extension and a rear corner extension. The front corner extensions of the side panels form right angles when assembled into the front corners of the shower base. A shower door is mounted between the two front corner extensions of the side panels. The rear corner extensions of the side panels are contoured and they bear against the flat back panel to form essentially rounded rear interior corners.

In their assembled, upright position, the side panels and back panel are reinforced by a top frame member and a centrally mounted U-shaped hand rail. The top frame member is rectangular and preferably is made of anodized aluminum. The top ends of the side and back panels are secured to the top frame member. An anodized aluminum hand rail is centrally attached to the side and back panels to reinforce the midsections of the upright panels as well as giving the user a place to hold.

A preferred embodiment of the improved shower base has a one-piece rectangular frame or base plate and a separate top floor surface that fits inside the open top of the base plate. The rectangular base plate has a bottom wall, vertical side walls, and a horizontally disposed interior ledge below the top open end of the base plate. Plural raised, integral ribs extend upwardly from the bottom of the base plate. The top floor surface fits snugly inside the periphery of the open end of the base plate to be supported by the interior ledge of the base plate, and the floor has a central drain opening. The raised ribs or spacers on the bottom of the base plate support the remaining portions of the top floor surface, thus providing a water collection space overlying the base plate bottom wall and beneath the top floor surface and into which water flows freely through the floor opening.

The rectangular base plate of the preferred base embodiment is capable of selected center or side drainage. One of the side vertical walls of the base plate has a selectively usable punchout for a drain pipe or, alternatively, a stub pipe pre-assembled in the side wall opening. The base plate bottom wall also has a selectively usable punchout for a center drain. In use, no load is imposed upon either punchout, so there is no danger of accidental or nonintentional removal of either punchout.

In an alternative embodiment, the rectangular base plate has a bottom with depressions or troughs to allow the water to drain either to a side opening drain or a center opening drain. In the second embodiment, a honeycombed support is interposed between the base plate and the upper floor to provide the water collection space.

The top floor surface in both embodiments has a center drain and notched edges that permit waste water to drain from the floor surface into the base plate and out through the selected, punched-out opening. The top floor surface also has a raised annular portion adapted to conform to a portion of a side drainpipe that enters the base plate and extends slightly above the horizontal plane of the interior ledge.

The present invention provides numerous advantages not found in the prior art. First, the shower enclosure is simplified by using lightweight, sculptured panels which provide maximum interior space. Second, the improved shower base units are capable of center or side draining and are conveniently sized for packaging.

Other advantages and meritorious features of the present invention will be more fully appreciated from the following detailed description and the appended claims.

THE DRAWINGS

FIG. 5 is a fragmentary plan view on an enlarged scale of the base shown in FIG. 1 and corresponding to the base shown in FIG. 2, with portions of the top floor being broken away to show the base plate and spacer construction.

FIG. 6 is a fragmentary section on an enlarged scale taken in the direction of arrows 6—6 of FIG. 5.

FIG. 7 is a fragmentary section on an enlarged scale taken in the direction of arrows 7—7 of FIG. 5.

FIG. 8 is a fragmentary perspective view of a modified spacer construction separately interposed between the base plate and floor, said spacer being shown on an increased scale.

It will be understood that the above drawings illustrate a preferred embodiment of the invention, and that other embodiments are contemplated within the scope of the claims hereinafter set forth.

DETAILED DESCRIPTION OF THE INVENTION

Figure 1:
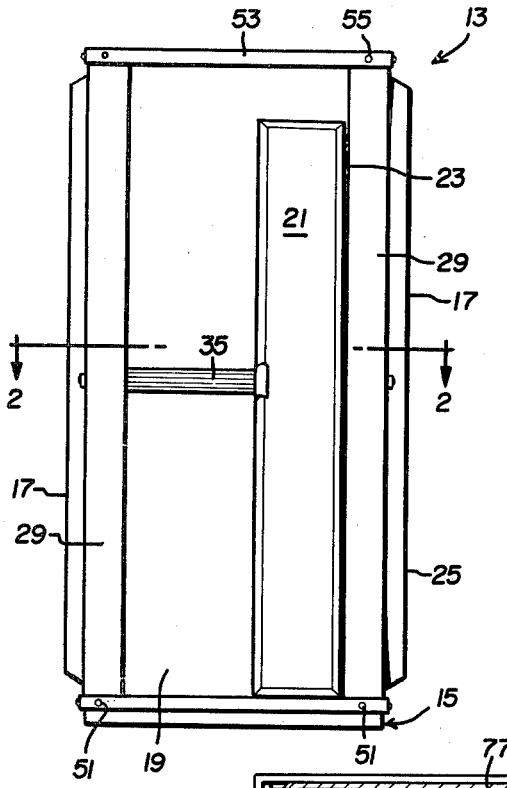
FIG. 1 is a front elevational view of the present shower cabinet and base.

Referring to the drawings and particularly FIG. 1, the present shower cabinet is generally indicated at 13 and includes a base 15, a pair of opposed side panels 17, a back panel 19 and a door 21 hinged at 23 to a portion of one of the side panels.

In the preferred embodiment, the panels are of a suitable plastic material such as a polystyrene or more specifically, a material referred to as acrylo-nitrile-butadiene-styrene, or equivalent materials.

Other materials may be employed for the formation of the side and back panels.

The respective panels have throughout their height a series of transversely spaced corrugations or sculptured reinforcements 25 to strengthen the panels and at the same time, utilize the minimum of material and to maintain the stiffness of the panels whose lower end portions are disposed within and mounted upon the base 15 and suitably secured thereto.

Figure 2:
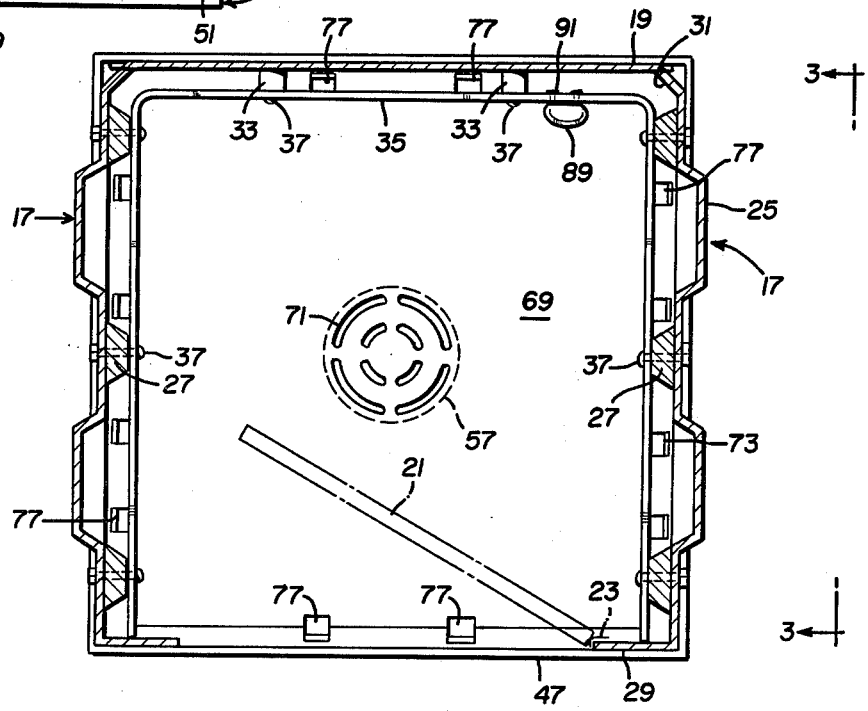
FIG. 2 is a section on an enlarged scale taken in the direction of arrows 2—2 of FIG. 1.

Each of the side panels terminates in a corner extension or front flange 29, as shown in FIG. 2, which front flanges are in alignment and opposed to each other to define a door opening within which is positioned the door 21 hinged as at 23 to one of the front flanges 29.

Each of the side panels 17 have a back angle flange 31 which extends at an obtuse angle to the respective panel and is adapted to snugly overly and bear against interior surface portions of the back panel 19 in a sealing line of contact therewith to complete the enclosure shown in FIG. 1.

A plurality of spaced bosses 27 project inwardly from the respective side panels, are coplanar with each other and coplanar with a corresponding plurality of spaced bosses 33 which project inwardly from said back panel.

A metallic hand rail 35 of U-shape, constructed of aluminum or other metal is spaced from the respective side and back panels, bears against the respective bosses and is secured thereto by a series of fasteners 37.

The hand rail, therefore, functions as a hand rail but, at the same time, provides a central horizontally disposed reinforcement to maintain the assembly between the respective side and back panels.

As shown in FIG. 1 and FIG. 7, the lower portions or edges of the respective panels including the front flanges 29 extend down into the base and are suitably secured thereto to a series of spaced fasteners 51.

The present base, generally designated at 15, includes a base plate 39 preferably of a thermo-formed plastic material, such as some form of polystyrene or other styrene as mentioned above.

In one embodiment of the invention, a suitable spacer is applied to the base plate 39 and is adapted to provide a water well in the base plate for water accumulation prior to discharge.

In the embodiment shown in FIGS. 1, 6 and 7, the base plate includes as said spacer, a series of upstanding spacer bosses 41 molded as a part of the base plate and arranged in a series of spaced rows, as best shown in FIG. 5. Each of the bosses 41 has, at its upper extremity, a substantially planar support face 43.

Said base plate includes a continuous upstanding peripheral side wall 45. An upstanding continuous outwardly displaced peripheral side flange 47 is connected to side wall 45 and defines therebetween the horizontal peripheral support shoulder 49, FIG. 7. The respective lower edges of the panels including the corner panels 29 project down into the base, for bearing support on the continuous peripheral shoulder 49 and are secured to the flange 47 by a series of laterally spaced fasteners 51.

As shown in FIG. 1, a top frame in the form of a hollow rectangular band 53 encloses and extends around the upper edge portions of the respective panels including the corner extensions or front flanges 29 and is secured thereto by a series of fasteners 55.

The band 53 is metallic, preferably aluminum or other equivalent material, and though it may be discontinuous, it is in effect continuous since it is secured to the adjacent portions of the respective panels throughout 360°. This provides a means for rigidly retaining together the upper end portions of the respective panels to complete the assembly shown in FIG. 1.

The center of the base plate bottom wall is provided with a portion of reduced thickness to define a selectively usable knockout drain disc 57, which, if knocked out, provides a drain opening circumscribed by an annular drain flange 59 to supportably receive drain assembly 61, fragmentarily shown in FIG. 6.

Figure 4:
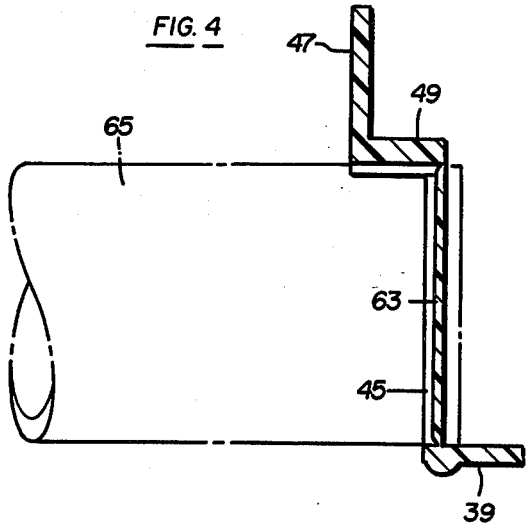
FIG. 4 is a fragmentary section on an enlarged scale taken in the direction of arrows 4—4 of FIG. 3.
Figure 3:
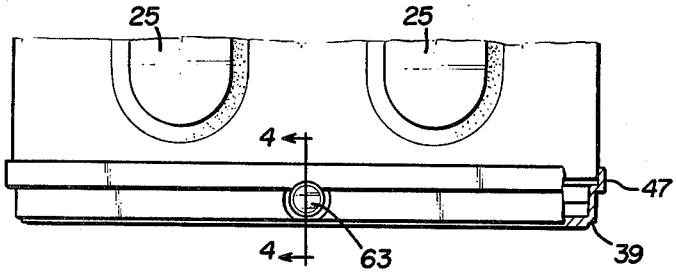
FIG. 3 is a fragmentary side elevational view of the lower portion of the cabinet and base taken in the direction of arrows 3—3 of FIG. 2.

Also formed within the side wall 45 is a reduced thickness portion providing an upright selectively usable knockout drain disc 63, FIG. 4, which, if knocked out, provides a lateral opening, as shown in FIG. 3, adapted to receive a suitable side drain pipe fitting 65, fragmentarily shown.

In the preferred embodiment of the invention and as shown in FIG. 5, the base plate bottom wall is pitched downwardly and inwardly towards the knockout drain disc 57, such as shown at 67, FIG. 5.

The nature of this pitch is approximately 0.002 inches. This is particularly useful if the centrally disposed selectively usable knockout drain disc 57 is removed for a central drain.

Nested within the base plate 39 and its side walls 45 and the peripheral flange 47 is a floor 69, preferably of plastic material, preferably rectangular in shape in the present embodiment.

As shown in FIGS. 6 and 7, said floor may be a molded unit removably disposed within said base plate. Alternately, the base plate, the floor 69 and the spacer bosses 41 could be of a unit construction in plastic and could be blow-molded for illustration as a unit.

Floor 69 has a centrally disposed drain opening 71 which is spaced above the selectively usable knockout drain disc 57, FIG. 6.

The floor 69 which is snugly nested down into the base 15, rests upon the spacer bosses 41. The floor preferably includes a raised, continuous, peripheral side wall 73 which bears against base side wall 45 and terminates in a raised laterally extending peripheral flange 75 which rests upon shoulder 49, FIG. 7.

A series of drain slots 77 are spaced apart around the periphery of the floor 69 and extend through portions of peripheral walls 73 as well as the support flange 75, all as shown in further detail in FIG. 5. These slots, together with the central opening 71, provide communication between the top surface of floor 69 and the collection space defined between the floor and the base plate 39. Water from the collection space drains through either (1) the selectively usable central drain opening defined by knockout disc 57, or (2) the side drain opening defined by the selectively usable knockout disc 63 formed within the side wall 45 of the base plate.

As shown in FIG. 5, the floor has a pitch which extends downwardly and inwardly towards the drain opening 71, as shown by the lines 79. The collection space provides a head of water to force drain the space laterally through the side opening, if this opening is utilized.

The drain assembly 61, fragmentarily shown in FIG. 6, includes a conventional drain body 81 which has at its top an annular tapered top flange 83 which takes the place of the knockout disc 57 when removed from the base plate and is assembled down into the opening within drain flange 59 and suitably secured thereto. Conventionally, the drain body receives suitable gaskets or washers to seal the connection of the top flange 83, designated in dash lines in FIG. 6, to replace the knockout disc 57 and is suitably secured in place by a conventional nut threaded onto an upper portion of the drain body.

The drain assembly includes the drain pipe 85, fragmentarily shown.

The hand rail 35 performs the additional function of providing a support for the soapdish 89 whose rearwardly connected clips 91 snap over corresponding portions of the hand rail in any desired location thereover, such as shown in FIG. 2.

With respect to the spacer means interposed between base plate 39 and the floor 69, another embodiment of the invention is shown in FIG. 8. Here, the spacer 93 is molded as a separate piece in the nature of a honeycomb construction which is interposed between the base plate 39 and the floor 69. The honeycomb comprises upstanding walls lying normal to one another and of a height equivalent to the height of the spacer bosses 41. The bottom edges of the walls are notched to accomodate drainage of water from the collection space to the selected drain opening.

With respect to the base assembly 15 as shown in particular detail in FIGS. 2, 5, 6 and 7, there is provided the selectively usable knockout disc 57 normally forming an integral part of the base plate 39 and when used, defining an opening to cooperatively receive the drain assembly 61 as shown in FIG. 6. There is additionally formed within the side wall 45 of the base plate at least one upright selectively usable knockout disc 63 which, if removed, defines a drain opening adapted to receive a suitable drain assembly or conduit 65, fragmentarily shown in FIG. 4 and with provision therefore shown in FIG. 5. Of course, only one of the selectively usable drain discs 57 or 63 would be knocked out depending upon whether a central drain is to be used as in FIG. 6 or, alternatively, a side drain is to be used, as in FIG. 4. A person using the shower stands on the floor 69, with his weight being transferred primarily to the floor through the spacer bosses 41. No substantial load is imposed upon either of the knockout discs, and there is no danger of either disc being accidentally pushed out.

While an assembly of the complete shower cabinet is shown in FIG. 1 including panels and doors mounted and supported upon the base 51, it is contemplated that the base assembly itself as a sub-combination, may be employed with other types of shower cabinets of the general arrangement shown in FIG. 1, which are supportably mounted within and upon the base plate, above described.

Having described my invention, reference should now be had to the following claims.

1. A shower cabinet comprising a base, upstanding side and back panels supported upon and fixed to said base;

and a door hinged to a side panel;

said base including a rectangular base plate;

a centrally disposed selectively usable knockout drain disc formed in said base plate providing a normally closed opening, adapted to selectively receive a drain assembly;

an upstanding peripheral side wall on said base defining a water well;

an outwardly displaced peripheral side flange on said side wall defining a horizontal peripheral support shoulder between said side wall and flange;

a selectively usable knockout drain disc formed within said side wall providing a normally closed opening, adapted to selectively receive a drain assembly;

spacer means on said base plate extending over the surface thereof;

(and) a floor seated on said support shoulder and over said spacer means, said floor also having a central drain;

an upstanding peripheral side wall extending around said floor cooperatively bearing against said base plate side walls;

a raised laterally extending peripheral flange on and around said floor mounted on said base plate shoulder;

the top surface of said floor along lines between diametric corners thereof being pitched downwardly towards said floor drain;

the top surface of said base being pitched downwardly towards the center thereof;

water from said cabinet draining through the central drain in said floor into said base well to be removed through that selected one of said openings from which said disc has been removed.

2. In the cabinet of claim 1, said spacer means including a series of spaced rows of spaced upstanding bosses formed within said base plate having top support faces, said spaced bosses cooperatively providing therebetween clear and unobstructed flow paths to each of said knockout drain discs.

3. In the shower cabinet of claim 1, opposed front flanges along one upright edge of said side panels and extending at right angles thereto respectively, said door being connected to one of said front flanges.

4. In the shower cabinet of claim 1, removal of said base plate knockout disc providing within said base plate a depressed annular drain flange;

said drain assembly including an apertured top flange nested within said base plate opening supporting on and secured to said drain flange.

5. In the shower cabinet of claim 1, said spacer means being of a plastic material and formed as a honeycombed structure nested within said base plate side walls and of such height to provide for water accumulation prior to discharge for proper pressure and lateral flow of a certain quantity of water.

6. In the shower cabinet of claim 1, opposed front flanges along one upright edge of said side panels and extending at right angles thereto respectively, said door being connected to one of said front flanges;

and a rear flange along the other upright edge of each side panel, extending at an acute angle to said back panel and respectively engaging said body panel along sealing lines of contact therewith.

7. In the shower cabinet of claim 1, there being a series of spaced drain slots through said floor at the edge thereof adjacent said upstanding base peripheral side wall and arranged around said floor.

8. A base adapted to mount a shower cabinet comprising;

a rectangular base plate;

a centrally disposed selectively usable first knockout drain disc formed in said base plate, providing a normally closed opening adapted to selectively receive a drain assembly;

an upstanding peripheral side wall on said base plate;

an outwardly displaced peripheral side flange on said side wall defining a horizontal peripheral support shoulder between said side wall and flange;

an upright selectively usable second knockout drain disc formed in said side wall providing a normally closed opening adapted to selectively receive a drain assembly;

spacer means projecting upwardly from said base plate interiorly of said side wall;

a floor having a central drain nested within said base plate side walls and superimposed on said support shoulder and over said spacer means to provide a water collection space intermediate said floor and said base plate, which water space can drain through the selected one of said openings;

an upstanding peripheral side wall extending around said floor cooperatively bearing against said base plate side walls;

a raised laterally extending peripheral flange on and around said floor mounted on said base plate shoulder;

the top surface of said floor along lines between diametric corners thereof being pitched downwardly towards said floor drain;

the top surface of said base being pitched downwardly towards the center thereof.

9. In the base of claim 8, said spacer means including a series of spaced rows of spaced upstanding bosses formed within said base plate having top coplanar support faces engaging said floor.

10. In the base of claim 8, removal of said base plate knockout disc providing with said base plate a depressed annular drain flange;

said drain assembly including an apertured top flange nested within said base plate opening and supported and secured to said drain flange.

11. In the base of claim 8, said spacer means being of a plastic material formed as a honeycomb assembly nested within said base plate side walls.

12. A base adapted to mount a shower cabinet comprising:

a rectangular base plate mounted on and bearing against a floor;

a centrally disposed selectively usable first knock out drain disc formed in said base plate, providing a normally closed opening adapted to selectively receive a drain assembly;

an upstanding peripheral side wall on said base plate defining a water well;

an outwardly displaced peripheral side flange on said side wall defining a horizontal peripheral support shoulder between said side wall and flange;

an upright selectively usable second knock out drain disc formed in said side wall providing on removal an outlet opening;

a lateral drain pipe extending through said opening and connected to said base plate side wall communicating with said water well;

spacer means projecting upwardly from said base plate interiorly of said side wall;

a floor having a central drain nested within said base plate side walls and superimposed on said spacer support shoulder and over said means above said base plate to provide a water collection space within said well intermediate said floor and said base plate;

drain said water well being configured such that water accumulating in said well to a depth sufficient to define a water head for the lateral outletting of water through said lateral drain pipe;

an upstanding peripheral side wall extending around said floor cooperatively bearing against said base plate side walls;

a raised laterally extending peripheral flange on and around said floor bearing against said base plate shoulder;

the top surface of said floor along lines between diametric corners thereof being pitched downwardly towards said floor drain.

* * * * *